US006920711B2

(12) United States Patent
Miller et al.

(10) Patent No.: US 6,920,711 B2
(45) Date of Patent: Jul. 26, 2005

(54) PHOTO DISPLAY SYSTEM FOR USE WITH IMAGED TRANSPARENCIES

(75) Inventors: Alan G. Miller, Austin, TX (US); Douglas P. Hills, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/393,039

(22) Filed: Mar. 20, 2003

(65) Prior Publication Data

US 2004/0181990 A1 Sep. 23, 2004

(51) Int. Cl.[7] ..... A47G 1/06
(52) U.S. Cl. ..... 40/715; 40/716; 40/765
(58) Field of Search ..... 40/701, 709, 714, 40/715, 716, 754, 765, 771, 791

(56) References Cited

U.S. PATENT DOCUMENTS

| | | | | | |
|---|---|---|---|---|---|
| 146,880 | A | * | 1/1874 | Dauthendey | 40/716 |
| 256,353 | A | * | 4/1882 | Mills | 40/722 |
| 1,591,957 | A | | 7/1926 | Berry et al. | |
| 2,276,776 | A | | 3/1942 | Hofmann | |
| 2,313,453 | A | * | 3/1943 | Rubel | 40/701 |
| 2,588,545 | A | | 3/1952 | Lawrence | |
| 2,651,129 | A | | 9/1953 | Spertus | |
| 2,654,173 | A | | 10/1953 | Christensen et al. | |
| 2,983,061 | A | | 5/1961 | Maiershofer | |
| 3,270,451 | A | * | 9/1966 | Bartleson et al. | 40/563 |
| 3,548,527 | A | * | 12/1970 | Acosto et al. | 40/754 |
| 3,771,245 | A | | 11/1973 | Mabrey et al. | |
| 3,803,737 | A | | 4/1974 | Beckett | |
| 4,733,485 | A | * | 3/1988 | Ozeki | 40/361 |
| 4,835,661 | A | | 5/1989 | Fogelberg et al. | |
| 4,942,685 | A | | 7/1990 | Lin | |
| 5,020,252 | A | | 6/1991 | DeBoef | |
| 5,130,825 | A | | 7/1992 | Kok-Schram De Jong | |
| 5,247,745 | A | | 9/1993 | Valentino | |
| 5,270,101 | A | | 12/1993 | Helicher | |
| 5,295,221 | A | | 3/1994 | Roslan | |
| 5,367,801 | A | * | 11/1994 | Ahn | 40/714 |
| 5,657,563 | A | * | 8/1997 | Lane | 40/219 |
| 5,899,012 | A | | 5/1999 | Crum | |
| 5,943,801 | A | | 8/1999 | Wilkinson | |
| 6,282,821 | B1 | | 9/2001 | Freier et al. | |
| 6,338,216 | B1 | * | 1/2002 | Young | 40/745 |
| 6,641,880 | B1 | | 11/2003 | Deyak et al. | |
| 2001/0045039 | A1 | | 11/2001 | Lee | |

FOREIGN PATENT DOCUMENTS

| | | |
|---|---|---|
| FR | 960.936 | 4/1950 |

OTHER PUBLICATIONS

U.S. Application entitled "Photo Display System With Powered Backlighting", filed Mar. 20, 2003, having U.S. Appl. No. 10/393,221.

* cited by examiner

*Primary Examiner*—Gary C. Hoge
(74) *Attorney, Agent, or Firm*—Gregg H. Rosenblatt; Yen Tong Florczak

(57) ABSTRACT

The present invention provides for a photo display system having a decorative frame, an imaged transparency disposed on the decorative frame and a diffuser film disposed on the imaged transparency. The photo display system also has a base having a means for mounting the decorative frame and a means for attaching a diffuse reflector. The diffuse reflector is disposed behind the decorative frame as viewed from the imaged transparency side of the photo display system.

21 Claims, 3 Drawing Sheets

PHOTO DISPLAY SYSTEM FOR USE WITH IMAGED TRANSPARENCIES

CROSS-REFERENCE TO RELATED APPLICATION

The present invention is related to copending, coassigned U.S. patent application Ser. No. 10/393,221 filed on even date herewith.

FIELD OF INVENTION

The present invention relates to a photo display for use with transparencies. In particular, the present invention relates to a picture frame that uses imaged transparencies.

BACKGROUND

Traditional picture frames are widely available in the market for displaying photos such as those taken from a 35 mm camera. Typically, the traditional picture frame contains a frame mounted on a stand. The frame may contain a decorative border and usually has a protective cover, such as a glass pane to protect the underlying photo.

With the advent of digital cameras, photo scanners and printers, consumers can now readily print a photographic quality image onto a substrate such as a photo-paper. Although photographic quality images can also be printed on transparencies, the traditional picture frames are not useful for displaying the imaged transparencies because the image can appear undesirably dark. To solve this problem, some skilled in the art have resorted to backlighting the imaged transparency to produce a brilliant image. Some display systems known in the art use incandescent or fluorescent lamps powered by standard electrical circuits, such as a 110-volt alternating current (AC). These AC powered display systems usually use a power cord, which may be cumbersome and unsightly and may restrict the consumer's flexibility in displaying the system.

Thus, there is a need in the art for different types of photo display systems that can take advantage of the visually pleasing backlit transparencies and enable their use under most typical viewing conditions.

SUMMARY

The present invention provides for a system for backlighting an imaged transparency without using a dedicated light source. In one exemplary embodiment, the present invention is a picture frame that relies on ambient light to illuminate an imaged transparency. A dedicated light source for the picture frame is not necessary.

In another exemplary embodiment, the present invention relates to a photo display comprising: (a) a decorative frame, an imaged transparency disposed on the decorative frame, and a diffuser film disposed on the imaged transparency; and (b) a base comprising a means for mounting the decorative frame and a means for attaching a diffuse reflector, wherein the diffuse reflector is disposed behind the decorative frame as viewed from the imaged transparency side of the photo display system.

In another exemplary embodiment, the present invention relates to a kit comprising: (a) a decorative frame; (b) an imageable transparency; (c) a diffuser film; (d) a diffuse reflector; and (e) a base comprising a means for attaching the diffuse reflector and a means for mounting the decorative frame.

The above summary of the present invention is not intended to describe each disclosed embodiment or every implementation of the present invention. The figures and detailed description that follow below more particularly exemplify illustrative embodiments.

BRIEF DESCRIPTION OF THE DRAWINGS

The invention can be further described with the figures below, wherein.

These figures are idealized, not drawn to scale and are intended only for illustrative purposes.

DETAILED DESCRIPTION

Figure 1:
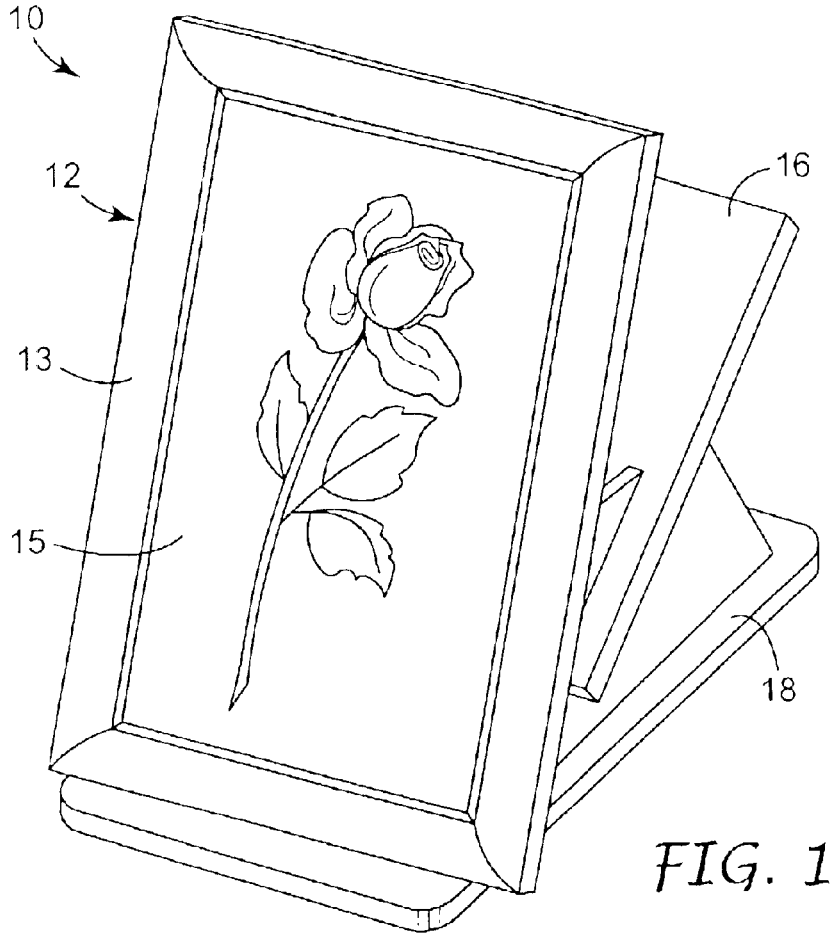
FIG. 1 is a perspective view of one exemplary embodiment of a photo display in accordance with the present invention.

FIG. 1 shows a perspective view of one exemplary embodiment of the present invention. Photo display system 10, such as a picture frame, contains decorative frame 12 that has border 13 and imaged transparency 15 where an image of a flower is displayed for the viewer. Decorative frame 12 is disposed on or mounted to base 18. The base further contains means for attaching diffuse reflector 16. As further described herein, the imaged transparency is disposed on the decorative frame and the diffuser film is disposed on the imaged transparency.

Figure 2:
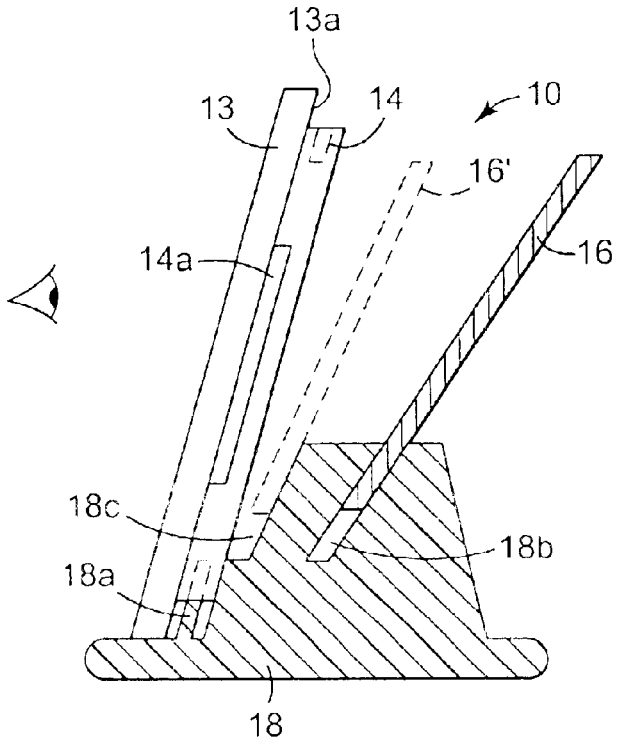
FIG. 2 is a side view of the embodiment in FIG. 1.
Figure 3:
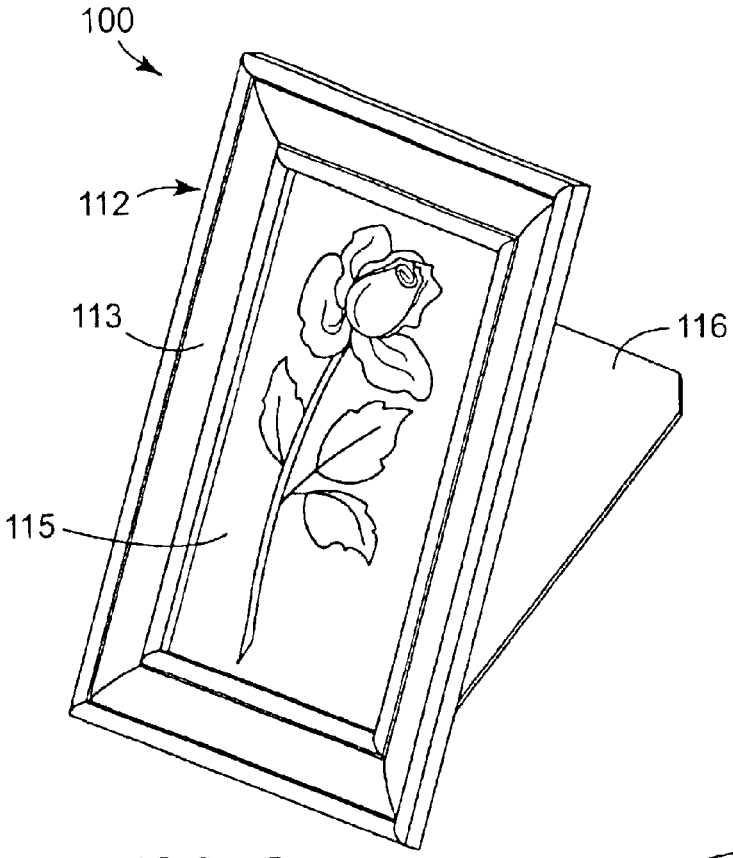
FIG. 3 is a perspective view of another exemplary embodiment of a photo display in accordance with the present invention.

FIG. 2 shows a side view of the photo display of FIG. 1 where on back surface 13*a* of the border is panel 14 having a plurality of slots 14*a*. The panel is not solid in that it traces the inside perimeter of the border such that the panel has an opening (not shown) that coincides with the opening on the decorative frame (not shown). In one exemplary embodiment, the panel is formed integrally with the border. Various means for mounting the decorative frame to the base can be used. In this particular embodiment, the means for mounting the decorative frame to the base is through stand 18*a* protruding from the base. The stand is of an appropriate dimension to mate with slot 14*a* of the panel. Although FIGS. 1 and 2 show the decorative frame mounted in portrait fashion on the base, it is possible to mount the decorative frame in a landscape fashion by rotating the decorative frame by 90 degrees. Because the panel contains slots on each of its side, it is possible to display the image in either portrait or landscape presentation. The base contains a means for attaching or mounting diffuse reflector 16 in more than one position, as indicated by position 16'. Multiple positions for mounting the diffuse reflector gives the viewer some flexibility in adjusting the image quality depending upon the amount of ambient light available. In the present embodiment, slits 18*b* or shoulder 18*c* can serve as means for attaching the diffuse reflector to the base. One skilled in the art will recognize that there are many different designs for the photo display system that can be used in the present invention, from different designs for the base as well as the decorative frame and different designs to mount the decorative frame to the base. One skilled in the art can further appreciate that there are many different methods for mounting the diffuse reflector to the base. For example, in another exemplary embodiment, the decorative frame contains fastening means in place of the panel. One exemplary fastening means is tabs that can rotate from a use position, allowing the imaged transparency and the diffuser film to be held in the decorative frame, to a non-use position, allowing the imaged transparency to be installed or removed from the decorative frame. For reference purposes, the photo display system has an imaged transparency side, as schematically represented by the eye in FIG. 2. The imaged transparency side is that side that a viewer would use to view the desired image FIG. 3 shows another exemplary embodiment of photo display system 100 having decorative frame 112 that has border 113 and imaged transparency 115. An image of a flower is displayed. Diffuse reflector 116 sits at an angle behind the decorative frame. One skilled in the art will recognize that there are various ways and various angles at which the diffuse reflector can be positioned. For example, in yet another exemplary embodiment, the means for mounting the diffuse reflector is designed to allow the diffuse reflector to be adjustable to different angles.

Figure 4:
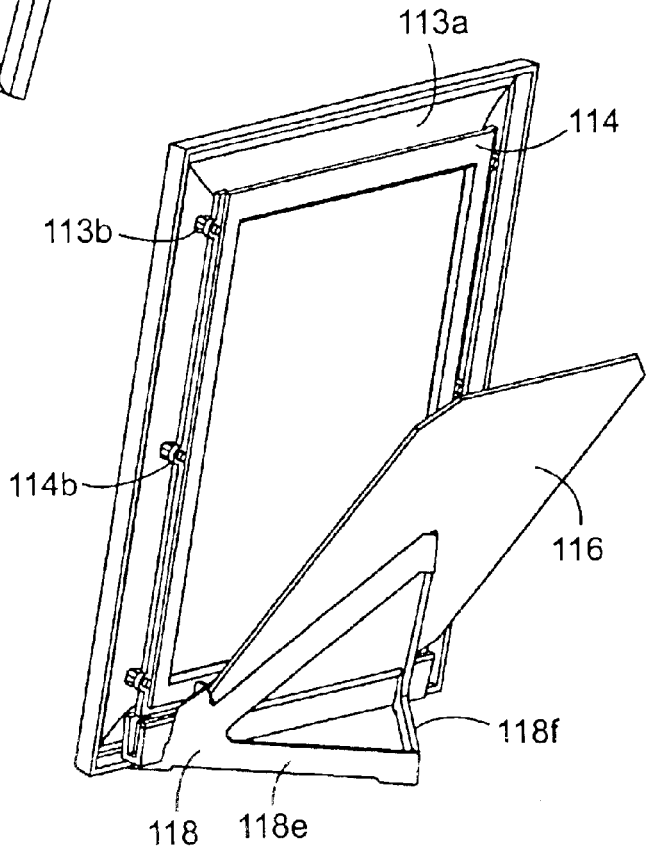
FIG. 4 is an isometric back view of the embodiment of FIG. 3.
Figure 5:
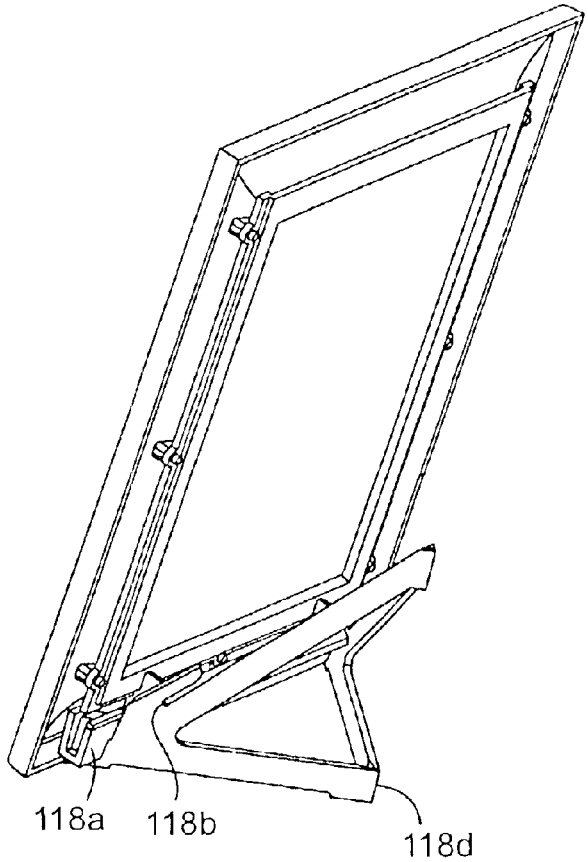
FIG. 5 is another isometric back view of the embodiment of FIG. 3.

FIGS. 4 and 5 show various back views of the embodiment of FIG. 3. Back 113*a* of the border contains a plurality of protrusions 113*b*. In one exemplary embodiment, panel 114 contains a plurality of circular openings 114*b* that interference fit with the protrusions. In another exemplary embodiment, the panel has previously been attached to the border by fastening means, such as an adhesive or by ultrasonic welding the panel to the border. Base 118 is triangular shaped having legs 118*e* and 118*f*. Clip 118*a* is part of the base and forms the third side of the triangular shaped base. Diffuse reflector 116 is disposed on slit 118*b* (FIG. 5) of the base. The decorative frame and panel are mounted on the base through the use of clip 118*a*. As best seen in FIG. 5, the bottom center protrusion-circular opening combination rests in a groove on the clip. In one exemplary embodiment, the imaged transparency and diffuser film are slid into slot 114*a* of the panel. In another embodiment, the diffuser film can previously be attached to the front side of the panel (not shown), i.e., the side that is in contact with backside 113*a* of the border. Various attachment means can be used, e.g., adhesives, fasteners, and welds. These figures also show that the base contains hinges 118*d*. In one exemplary embodiment, hinges 118*d* are living hinges.

The photo display of the present invention can also be formed into a kit for a consumer or user to reproduce an image and fabricate a personalized photo display system. In one exemplary embodiment of the present invention, the photo display system of the embodiment shown in FIGS. 3 to 5 are packaged in a kit containing at least one transparency ready for imagining, the decorative frame, the panel with or without the diffuser film being previously attached thereto, and the base. The base can be originally packaged as two separate substantially flat pieces, the first piece being the clip and the second piece being the leg portions. In use, the user can assemble the photo display by folding the leg portions at the living hinge and mounting the clip to create the base, installing the diffuse reflector on the base, imaging the transparency with a desired image and attaching it to the decorative frame and mounting the decorative frame on the base thereby display the desired image.

Figure 6:
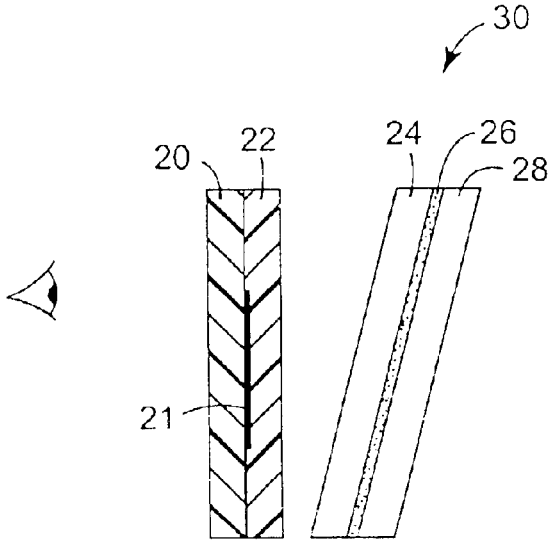
FIG. 6 is a schematic view of the exemplary materials that can be used in the present invention.

FIG. 6 shows a schematic representation of the various components used in the present invention to produce the photo display system. In one exemplary embodiment, imaged transparency 20 is disposed on diffuser film 22 and the combination is installed in the decorative frame by inserting the combination in slot 14*a* of the panel. The imaged transparency contains an image that the viewer wishes to display. The image can be formed on side 20*a* or side 20*b* of the transparency. In the case where the image resides on side 20*b*, the image is typically referred to as being a "buried" image and has the advantage of being protected from dust, fingerprints, and the like, by the transparency itself. In one exemplary embodiment, the diffuse reflector 30 contains light enhancement film 24 having a pressure sensitive adhesive backing 26. The light enhancement film functions primarily to gather ambient light and reflect the light towards the decorative frame. In this particular embodiment, the light enhancement film has been adhesively attached to a substrate 28. It is the combination of using an appropriate imaged transparency, an appropriate diffuser film and an appropriate light enhancement film that allows the viewer to see a quasi three-dimensional, bright, and brilliant image with ambient light, i.e., without the need for using added (non-ambient) dedicated lighting. These various components are described below in further detail below.

As used herein, the term "imaged transparency" means a polymeric film bearing an image thereon, the image typically being created by a printing process. Any polymeric transparency film capable of bearing an image can be used as the imaged transparency in the present invention. In general the greater the transparency and the lower the image haze, the brighter and more brilliant the image will appear to the viewer. In one exemplary embodiment, the image haze value of the imaged transparency is less than about 30% as measured using a GARDNER HAZE-GARD PLUS haze meter. In another exemplary embodiment, the image haze value of the imaged transparency is less than about 15% as measured using the GARDNER HAZE-GARD PLUS haze meter. The image that eventually appears on the imaged transparency can be created using ink jet printers, electrophotographic printers and copiers, and phase change ink jet printers, i.e., those using solid or phase-change inks.

Useful transparency films that can be used as the imaged transparency with ink jet printers includes 3M™ Transparency Films for Inkjet Printers commercially available from 3M Company, St. Paul, Minn. under product numbers CG3460, CG3480, and CG3490. Useful transparency films that can be used as the imaged transparency with electrophotographic printers and copiers include those commercially available from 3M Company under product designation CG3700, CG 3710, CG 3720 and CG5000. These transparency films along with the ones listed above are typically polyester based films having various coatings for processing through the different printing methods.

The diffuser film is disposed next to and behind the imaged transparency as shown in FIG. 6 such that when the viewer looks at the photo display system from the imaged transparency side, the viewer will see the imaged transparency but not the diffuser film. The diffuser film controls the amount of ambient light transmitted to the imaged transparency. The diffuser film also diffuses the ambient light to minimize any appearance of hot spots. In one exemplary embodiment, the diffuser film allows at least 20% of the ambient light to be transmitted. In another exemplary embodiment, the diffuser film allows at most 80% of the ambient light to be transmitted. A commercially available diffuser film can be obtained from the 3M Company from its Commercial Graphics Division under product designations 3M™ Diffuser Film 3635-70, which allows about 60% of the ambient light to be transmitted and 3M™ Diffuser Film 3536-30, which allows about 30% of the ambient light to be transmitted. These films are typically white and will appear uniform in both reflected and transmitted light. The diffuser films are about 0.003 to 0.004 inches (0.08 to 0.10 mm) thick. As of the filing date, additional product information on these films can be found on the www.scotchprintgraphics.com web site.

The light enhancement film is disposed behind the diffuser film. The light enhancement film functions to gather ambient light and reflect it to the diffuser. The reflected light is in the form of diffuse light. In one embodiment, the light enhancement film is a flexible polymer sheet having a pressure sensitive backing. When the light enhancement film is laminated to a substrate, a diffuse reflector is formed. The type of substrate upon which the light enhancement film is adhesively attached to is not critical, so long as a good bond is formed between the adhesive and the substrate. On skilled in the art will recognize that there are other light enhancement films available that have the appropriate physical properties, such as rigidity, to be used as a stand alone diffuse reflector. A commercially available light enhancement film can be obtained from the 3M Company from its Commercial Graphics Division under product designations 3M™ Light Enhancement Film 3635-100.

The photo display of the present invention can be used with a base for a traditional picture frame displayed on a desk, bookshelf, fireplace mantle, and the like. The photo display can also be used without a base for display on a window. In this particular application, the present invention would rely on the available outdoor lighting to achieve a backlit effect.

The photo display system of the present invention does not rely on the use of a powered light source. Due to its unique design and due to the efficient light collection of the diffuse reflector, an acceptable viewing location can be found in nearly every case to produce a backlit image. Overhead lighting typical in an office environment, daylight through a window, and various other light sources contribute to the ambient light used for the inventive photo display system.

What is claimed is:

1. A photo display comprising:

(a) a decorative frame, an imaged transparency disposed on said decorative frame, and a diffuser film disposed on said imaged transparency; and (b) a base comprising a mount for said decorative frame and a means for attaching a diffuse reflector, wherein said diffuse reflector is disposed behind said decorative frame as viewed from the imaged transparency side of the photo display system, wherein said decorative frame further comprises a panel on its rear side that mates with the mount, said panel further providing an open pocket for said imaged transparency to reside therein.

2. The photo display of claim 1, wherein said imaged transparency has a haze value of less than about 30%.

3. The photo display of claim 1, wherein said imaged transparency is generated from an inkjet printer, an electrographic printer, an electrographic copier, or a phase change inkjet printer.

4. The photo display of claim 1, wherein said diffuser film allows at least 20% of the ambient light to be transmitted.

5. The photo display of claim 1, wherein said diffuser film allows about 60% of the ambient light to be transmitted.

6. The photo display of claim 1, wherein said diffuse reflector comprises a pressure sensitive adhesive backed light enhancement film attached to a substrate.

7. The photo display of claim 1, wherein said mount comprises a raised stand.

8. The photo display of claim 7, wherein said panel further comprises at least one slot that mates with said raised stand.

9. The photo display of claim 8, wherein said panel includes a previously attached diffuser film.

10. The photo display of claim 8, wherein said panel is integrally formed with said decorative frame.

11. A kit comprising:

(a) a decorative frame;

(b) an imageable transparency;

(c) a diffuser film;

(d) a diffuse reflector; and (e) a base comprising a means for attaching said diffuse reflector and a mount for said decorative frame, wherein said decorative frame further comprises a panel on its rear side that mates with the mount, said panel further providing an open pocket for said imaged transparency to reside therein.

12. The kit of claim 11, wherein said kit is assembled by the following method:

(a) imaging said imageable transparencies with a desired image to yield an imaged transparency, (b) attaching said imaged transparency and said diffuser film to said decorative frame such that a viewer sees said desired image when looking at said decorative frame;

(c) mounting said decorative frame to said base; and (d) attaching said diffuse reflector to said base.

13. The kit of claim 12, wherein said imaging step is a process selected from the group consisting of inkjet printing, electrographic printing, electrographic copying, and phase change inkjet printing.

14. The kit of claim 12, wherein said imaged transparency has a haze value of less than about 30%.

15. The kit of claim 11, wherein said diffuser film allows at least 60% of the ambient light to be transmitted.

16. The kit of claim 11, wherein said diffuse reflector comprises a pressure sensitive adhesive backed light enhancement film attached to a substrate.

17. The kit of claim 11, wherein the mount comprises a raised stand and wherein said panel further comprises at least one slot that mates with said raised stand.

18. The kit of claim 17, wherein said panel includes a previously attached diffuser film.

19. The kit of claim 17, wherein said panel is integrally formed with said decorative frame.

20. The kit of claim 11, wherein said base is substantially flat and contains a living hinge.

21. The kit of claim 20, wherein said kit is assembled by the following method:

(a) imaging said imageable transparencies with a desired image to yield an imaged transparency;

(b) attaching said imaged transparency and said diffuser film to said decorative frame such that a viewer sees said desired image when looking at said decorative frame;

(c) preparing said base by folding it along said living hinge;

(d) mounting said decorative frame to said base; and (e) installing said diffuse reflector to said base.

* * * * *